US005979654A

United States Patent [19]

Apps

[11] Patent Number: 5,979,654

[45] **Date of Patent: *Nov. 9, 1999**

[54] NESTABLE DISPLAY CRATE FOR BOTTLE CARRIERS

[75] Inventor: William Patrick Apps, Alpharetta, Ga.

[73] Assignee: Rehrig Pacific Company, Los Angeles, Calif.

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 08/921,153

[22] Filed: Aug. 29, 1997

Related U.S. Application Data

[63] Continuation-in-part of application No. 08/423,347, Apr. 18, 1995, abandoned, which is a continuation-in-part of application No. 08/268,997, Jun. 30, 1994, Pat. No. 5,465,843, which is a continuation-in-part of application No. 29/018,317, Feb. 3, 1994, Pat. No. Des. 361,431, and a continuation-in-part of application No. 29/070,776, May 15, 1997, Pat. No. Des. 400,012.

[51] Int. Cl.[6] ..... B65D 21/032

[52] U.S. Cl. ..... 206/507; 206/506; 206/510; 206/518; 220/755; 220/756; 220/771

[58] Field of Search ..... 206/505, 506, 206/507, 509, 510, 511, 515, 516, 518, 519; 220/771, 772, 755, 756

[56] References Cited

U.S. PATENT DOCUMENTS

| | | | |
|---|---|---|---|
| 2,535,493 | 12/1950 | Gerber | 206/510 |
| 3,347,405 | 10/1967 | Motsenbocker et al. . | |
| 3,368,709 | 2/1968 | Waller . | |
| 3,473,690 | 10/1969 | De Cazenove . | |
| 3,506,154 | 4/1970 | Barnes . | |
| 4,364,477 | 12/1982 | Stromberg . | |
| 4,823,955 | 4/1989 | Apps . | |
| 5,060,819 | 10/1991 | Apps . | |
| 5,191,994 | 3/1993 | Stauble . | |
| 5,465,843 | 11/1995 | Koefelda | 206/505 |
| 5,651,461 | 7/1997 | Apps et al. | 206/511 |
| 5,704,482 | 1/1998 | Apps et al. | 206/510 |

*Primary Examiner*—Stephen Castellano
*Attorney, Agent, or Firm*—Brooks & Kushman P.C.

[57] ABSTRACT

A nestable display crate for bottle carriers having a floor and a wall structure with that is designed to reveal the labels on the bottle carriers. The wall structure is of double thickness and comprises a lower wall portion adjacent the floor and a plurality of integrally formed contoured upper wall portions extending upward from the lower wall portion. The wall structure is hollow throughout allowing the contoured upper wall portions to be received within the lower wall portion of a crate nested thereabove. The contoured upper wall portions are tapered to be smaller in cross section at the top and larger near the lower wall portion to enable easy nesting and to avoid nested crates from becoming wedged together due to interference. The upper wall portions are in the shape of gear teeth that are spaced along the opposing sidewalls and endwalls of the crate. The upper wall portions along the sidewalls are positioned so that they are between six-pack carriers when the crate is loaded, and the space in between the upper wall portions is a window that allows for a bottle carrier to be visible. The endwalls of the crate comprise integrally molded handles which are configured to allow for palm-up or palm-down gripping. The crate of the present invention combines the advantages of a nesting crate with sufficient strength afforded by its double-walled construction with maximum, unobstructed visibility of bottle carriers.

5 Claims, 8 Drawing Sheets

NESTABLE DISPLAY CRATE FOR BOTTLE CARRIERS

REFERENCE TO RELATED APPLICATIONS

This application is a CIP of Ser. No. 08/423,347, filed on Apr. 18, 1995, now abandoned, which is a CIP of Ser. No. 08/268,997, filed on Jun. 30, 1994, now U.S. Pat. No. 5,465,843, which is a CIP of 29/018,317, filed Feb. 3, 1994, now U.S. Pat. No. D361,431, this application is also a CIP of Ser. No. 29/070,776, filed May 15, 1997, now U.S. Pat. No. D400,012. These applications are incorporated herein by reference.

BACKGROUND OF THE INVENTION

The present invention relates to a nestable display crate for transporting and storing bottle carriers, more particularly, the present invention relates to crates that combine nestability and high strength with high visibility for multi-packs of bottles.

Bottles, particularly for soft drinks and other beverages, are often stored and transported during the distribution stages thereof in crates or trays. The term "crate" or "tray" as used herein includes crates, trays and similar containers having a floor bottom and peripheral sidewall structure. These crates generally are configured to be stacked on top of each other when loaded with bottles, and nested together when empty of bottles. The plastic crates provide advantages such as conservation of storage space and efficient, easy handling and recyclability. In order to minimize the storage space of the crates when nested and to reduce cost and weight, many crates today are made with a shallow peripheral sidewall structure. These generally are referred to as "low depth" crates in which the bottles bear most of the load of above-stacked crates. Crates having a higher peripheral sidewall, approximately the same height as the bottles generally are referred to as "full depth" crates in which the crates themselves bear most of the load of above-stacked crates.

Low depth crates are generally less expensive and lighter in weight than full depth crates. Thus, low depth crates are used extensively. Generally, it is desirable to design low depth crates with a wall structure that provides lateral support for the bottles while also allowing the bottles to be visible. with a wall structure that provides lateral support for the bottles while also allowing the bottles to be visible.

An example of a known low depth bottle crate for bottles of single serve capacity is disclosed in commonly assigned U.S. Pat. No. 5,060,819, the disclosure of which is also hereby incorporated by reference in its entirety. The bottle crate of the '819 patent has a sidewall structure with upright adjacent panels, alternating ones of which are raised such that their lower surfaces are spaced above the floor. The top and bottom edges of the sidewall thereby have an undulating configuration such that empty trays can nest together.

Crates for single serve bottles are customarily stacked on top of each other. One way of handling the loaded crates is to stack the cases on pallets which can be lifted and moved about by fork-lift trucks. A technique for interconnecting loaded crates is called cross-stacking, and is often used to improve stability of a stack of crates for transport or for display purposes by a retailer. An aspect of crate design is to provide the structural features which facilitate handling of stacked and cross-stacked loaded crates to enhance the stability of stacked crates, while providing maximum visibility of the bottles or bottle carrier, especially in a retail setting.

One of the problems associated with previous nestable crates, particularly, those for single serve bottles, has been lack of strength when used in some settings. The tray of the '819 patent, for instance, has a sidewall which may not stand up to very rough handling over time. Accordingly there has been a need for reusable nestable crates having the requisite strength and rigidity to withstand repeated or rough handling.

Another problem experienced with previous nestable crates has been somewhat limited visibility of the bottle or container labels. Although the sidewall of the tray in the '819 patent does allow for some of the bottle labels to be displayed, the wall obstructs the view of the containers to some degree. The obscured visibility problem has been more pronounced when the bottles are grouped together in a cardboard carrier or otherwise bundled because present crates are not designed to show the labels on the carriers or shrink wrap. There is a need for a nestable display crate which has improved and structural strength and provides bottle carrier visibility.

SUMMARY OF THE INVENTION

Accordingly, it is a principal object of the present invention to provide a low depth display crate for bottle carriers or multi-packs which is nestable with other similar crates when empty to conserve space, and which is stackable and cross-stackable with other similar crates when loaded with bottles for storing, displaying and transporting the multi-packs.

Another object of the present invention is to provide a low depth, nestable crate which has sufficient structural strength to withstand repeated and rough handling.

Another object of the present invention is to provide a sturdy low depth, nestable crate which also provides maximum visibility of the bottle carriers for display purposes.

Still another object of the present invention is to provide a low depth, nestable crate which makes efficient use of space both when loaded and stacked and when empty and nested. When loaded and stacked, the present invention also has structural features which securely engage the tops of variously sized bottle tops.

Directed to achieving these objects, a new low depth, nestable display crate for bottle carriers is herein provided. The preferred configuration is for four six-pack carriers of bottles. It will be understood that while the preferred embodiment of the present invention is configured for retaining six-pack bottle carriers, the crate may be used to store or transport any type of container and differently grouped multi-packs. This crate is formed by integrally molding from plastic, two basic components—a floor and a wall structure extending up from the floor and extending around the periphery of the floor.

The wall structure comprises a wall of double thickness with a lower wall portion adjacent the floor and a plurality of integrally formed contoured upper wall portions extending upward from the lower wall portion. The wall structure is hollow throughout allowing the contoured upper wall portions to be received within the lower wall portion of a crate nested thereabove. The contoured upper wall portions are tapered to be smaller in cross section at the top and larger near the lower wall portion to enable easy nesting and to avoid nested crates from becoming wedged together due to interference.

The contoured upper wall portions are preferably arranged along the opposing sidewalls of the crate and the endwalls. The upper wall portions along the sidewalls are positioned so that they are between six-pack carriers when the crate is loaded, and the space in between the upper wall portions is a window that allows for a bottle carrier to be visible. The endwalls of the crate comprise integrally molded handles which are configured to allow for palm-up or palm-down gripping. The crate of the present invention combines the advantages of a nesting crate with sufficient strength afforded by its double-walled construction with maximum, unobstructed visibility of bottle carriers.

The floor preferably has an open lattice design which not only allows unwanted fluids to drain out of the crate, but also requires less material and thus is lighter than a solid floor design. The floor also has bottle carrier support areas, preferably in an array.

The floor of the crate has an outer or bottom surface which is configured for accommodating the tops of bottles in a similar crate underneath. The floor bottom surface preferably has upwardly recessed receiving areas disposed to receive the tops of bottles contained in a similar crate therebeneath. The bottle top receiving areas aid in retaining the bottles vertically upright which enhances the stability of stacked loaded crates.

These and other features and advantages of the invention may be more completely understood from the following detailed description of the preferred embodiments of the invention with reference to the accompanying drawings.

DETAILED DESCRIPTION OF THE PREFERRED EMBODIMENT

Figure 1:
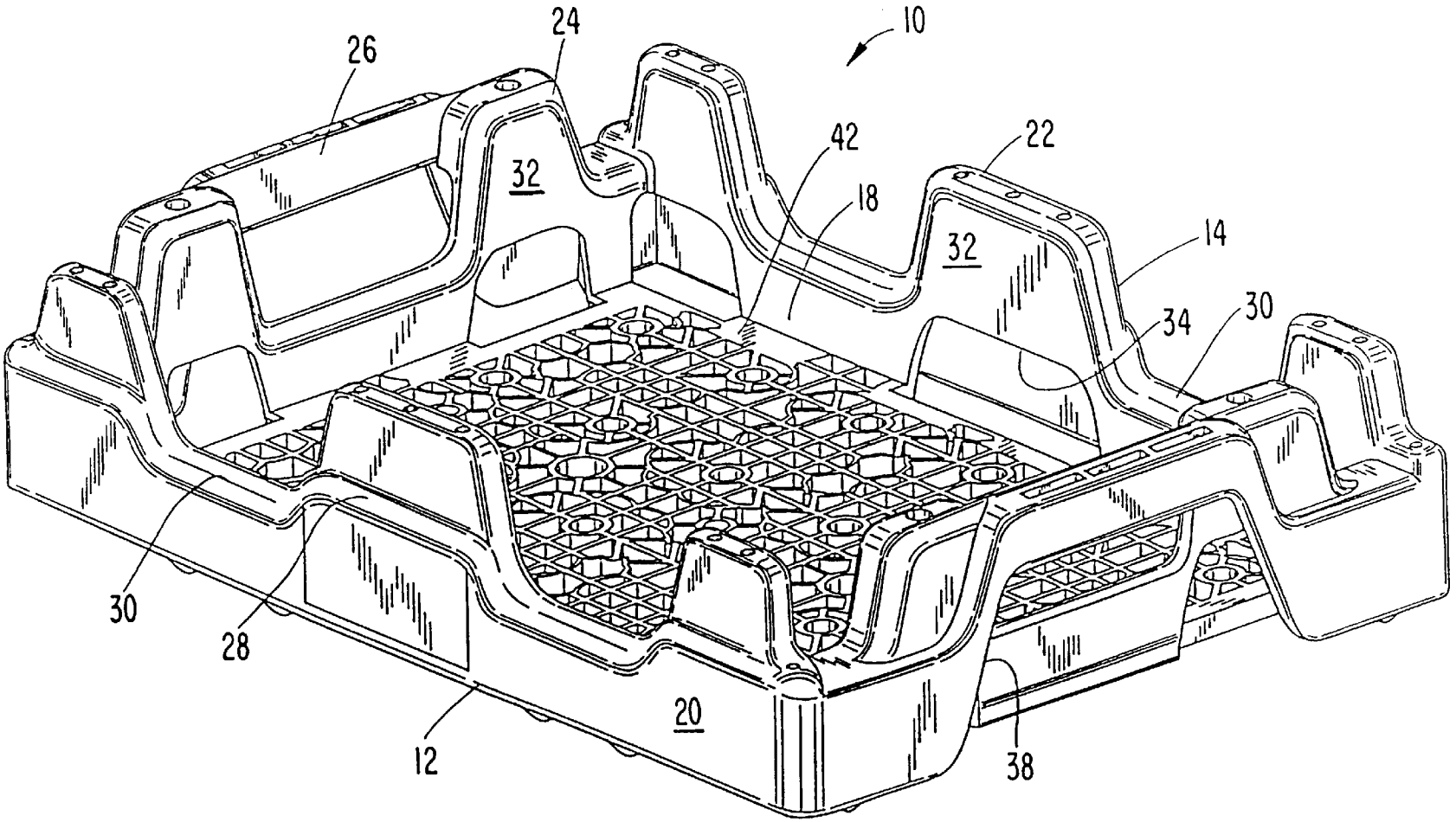
FIG. 1 is a top perspective view of a crate in accordance with the present invention.
Figure 2:
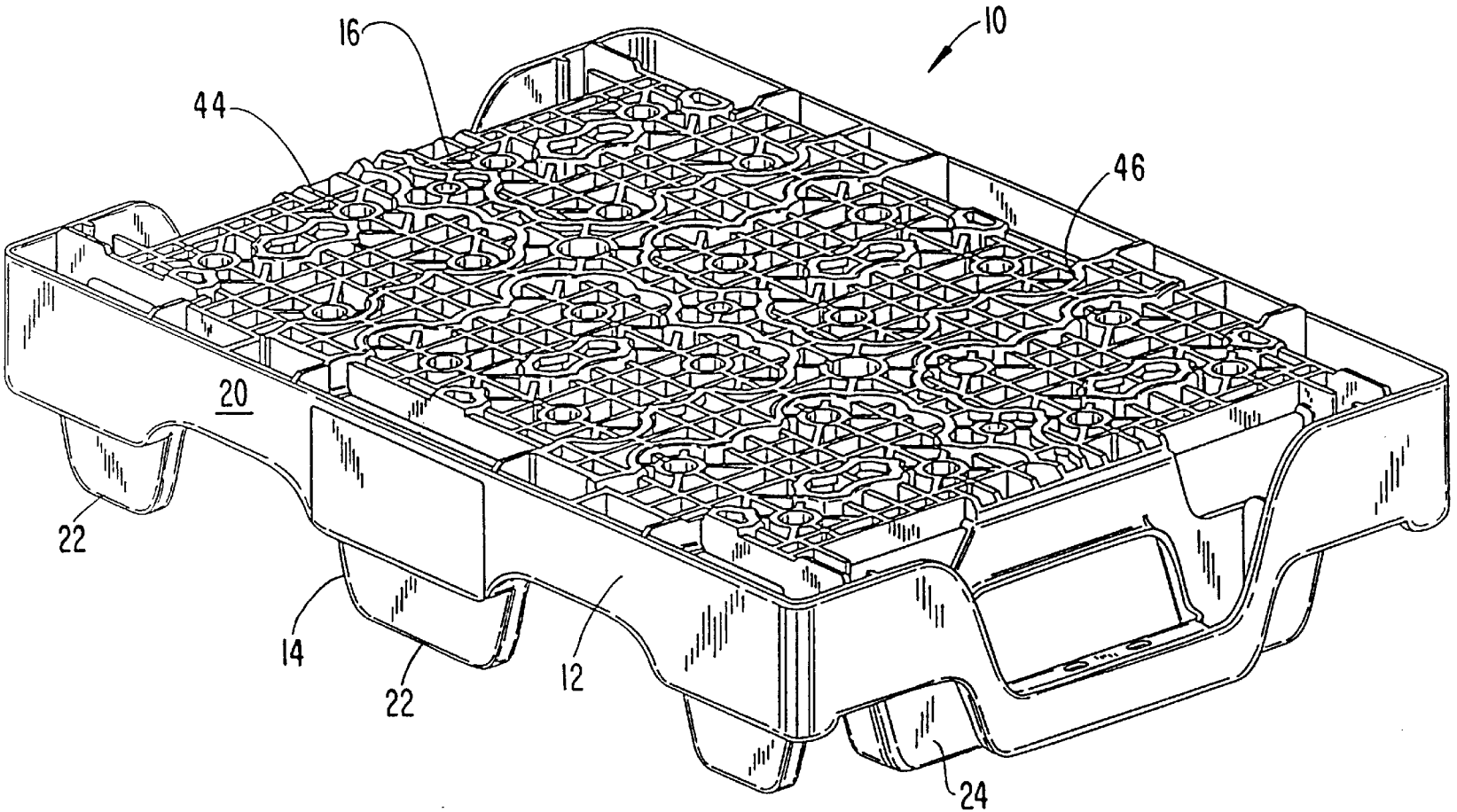
FIG. 2 is a bottom perspective view of the crate of FIG. 1.

Referring to FIGS. 1 and 2, crate 10 of the preferred embodiment comprises a wall structure with a lower wall portion 12, an upper wall portion 14 and a floor 16. Crate 10 is preferably rectangular and the wall structure comprises sidewalls and endwalls. Although a rectangular crate is shown and described, the present invention is not limited thereto and may comprise sidewalls and endwalls of equal length resulting in a square crate.

The wall structure is of double-thickness and defines the periphery of crate 10 with opposing sidewalls and opposing end walls. Lower wall portion 12 includes a plurality of interior panels 18 which are connected to floor 16, and an exterior surface 20 which forms an uninterrupted band along each of the sidewalls. Upper wall portion 14 comprises a plurality of trapezoid or rectangular shaped sidewall teeth 22 resembling gear teeth spaced along the sidewall, FIG. 3. Two endwall teeth 24 on each of the endwalls provide the supports for a handle 26, FIG. 4.

The exterior surfaces of the lower wall portion and teeth of the upper wall portion are integral and include a contoured step 28 where the teeth are inwardly directed and extend above the lower wall portion Step 28 is integral with top surfaces 30 of the lower wall portion that are arranged between teeth. Step 28 and top surfaces 30 form a shoulder which generally defines the portion of a crate that will be visible when crates are nested together. At the endwalls, handle 26 is supported on teeth 24 and protrudes outward slightly so that the exterior surface of handle 26 is flush with the lower wall portion.

As best seen in FIGS. 1 and 8–11, the interior surfaces of the wall structure include interior teeth panels 32 which are connected to interior lower panels 18 of the lower wall portions. Interior teeth panels 32 provide upper lateral supports for bottle carriers, and interior lower panels 18 provide lower lateral supports for the bottle carriers. Interior lower panels 18 are arranged along the periphery of the floor and alternate with cut-outs 34 which reduce the amount of material making the crate lighter in weight. Since the interior panels 18 are connected to the floor, free edges of the floor extend across cut-outs 34 in between panels 18. Viewed from the inside of the crate, these panels are arranged in alternating zig-zag fashion. The surfaces of these panels are flat to support the flat cardboard walls of carriers loaded with bottles.

The exterior surface of lower wall portion 12 has a central flat label portion 36 which can be used for molded in information, logos, advertisements and the like.

Figure 6:
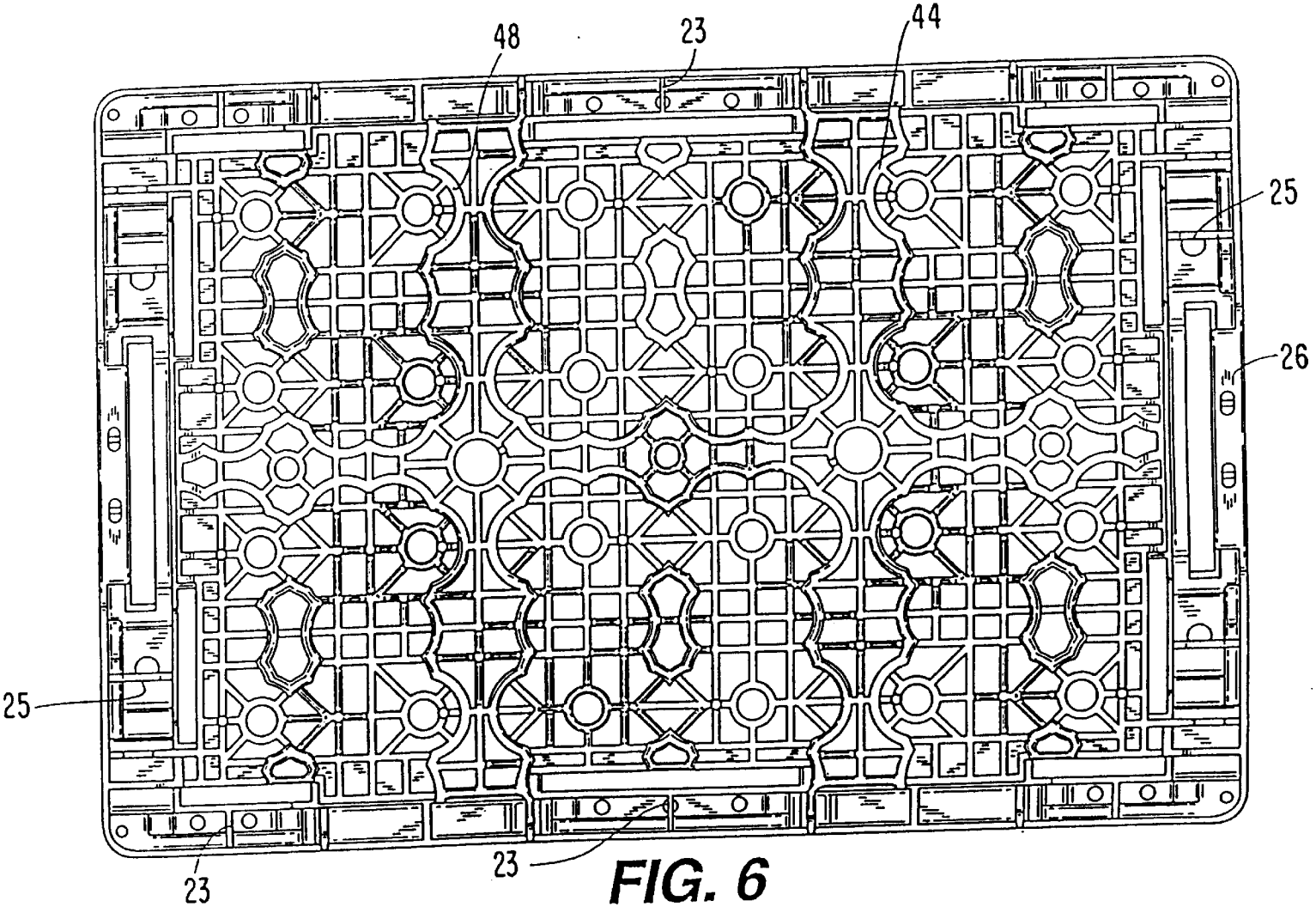
FIG. 6 is a bottom plan view of the crate of FIG. 1.

Teeth 22 and 24 are provided with internal ribs 23 and 25 respectively which bear against the tops of corresponding teeth in a similar crate when the crates are nested together. These nesting supports ensure that the weight of a column of nested crates is borne by sufficiently strong elements of the crate to provide stability and ensure that the wall structures do not fray from repeated use. These internal ribs 23 and 25 are integrally formed in the hollow spaces inside teeth 22 and 24. Ribs 23 and 25 are shown in FIG. 6 and in cross-section in FIGS. 8 and 9. Ribs 23 and 25 preferably are located in the upper part of teeth 22 and 24, and hidden from view by the interior and exterior surfaces of the teeth. FIG. 6 best illustrates how ribs 23 and span the inside of teeth 22 and 24, bridging their interior and exterior surfaces.

Figure 7:
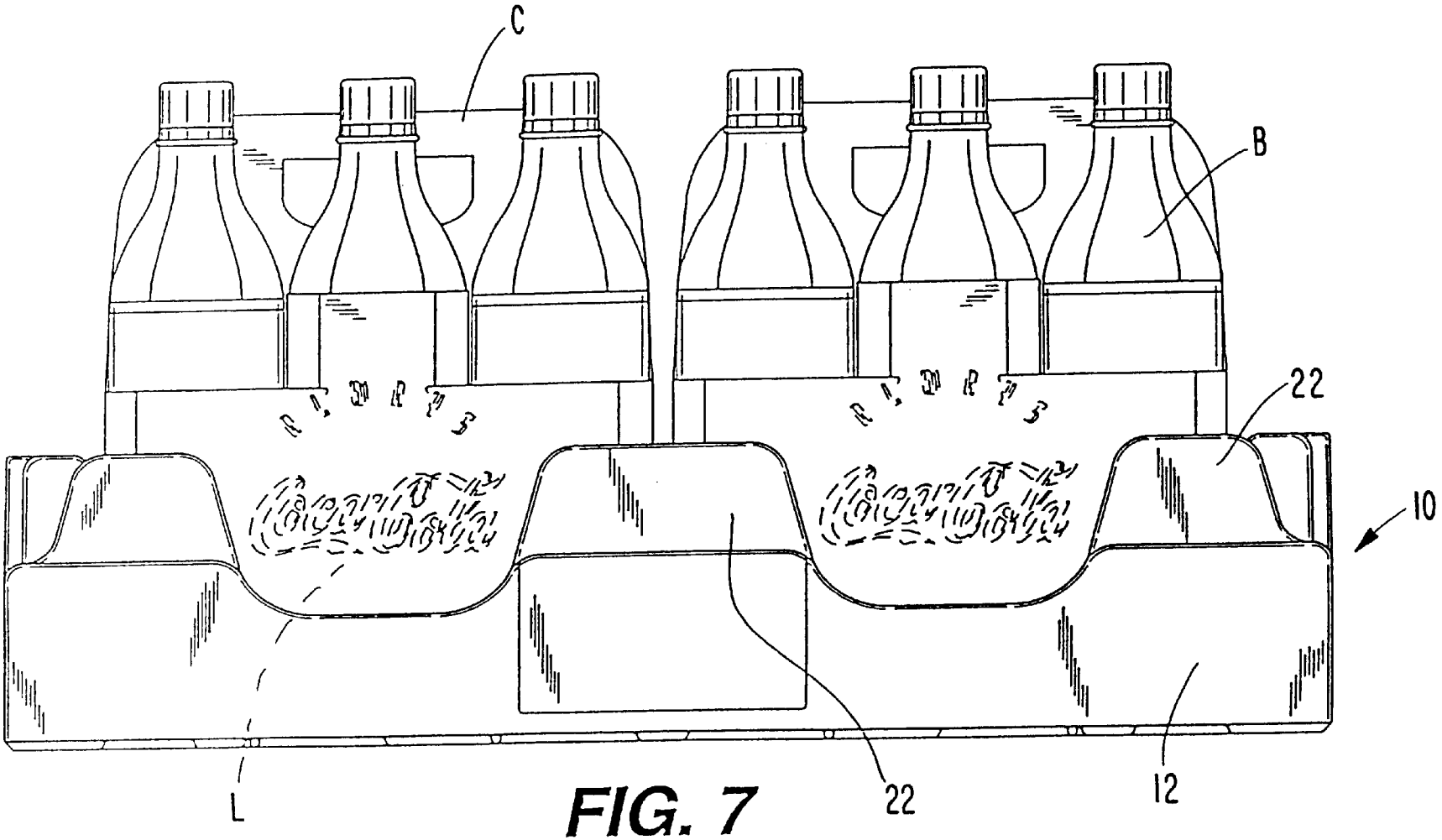
FIG. 7 is a side elevational view of the crate of FIG. 1 shown loaded with six-pack carriers of bottles.
Figure 8:
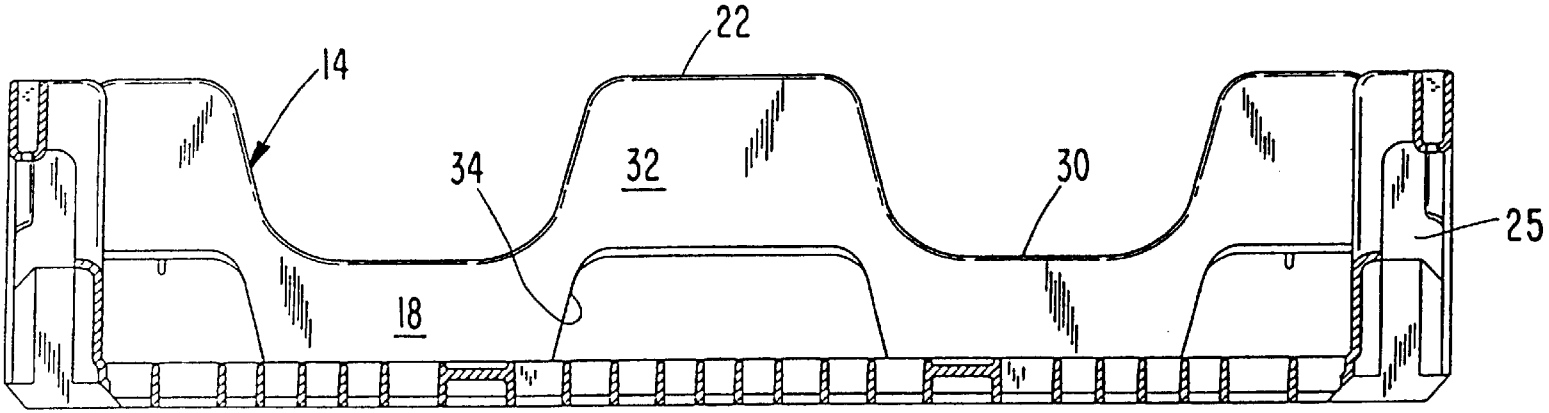
FIG. 8 is a cross-sectional view of the crate taken along line 8—8 of FIG. 5.
Figure 9:
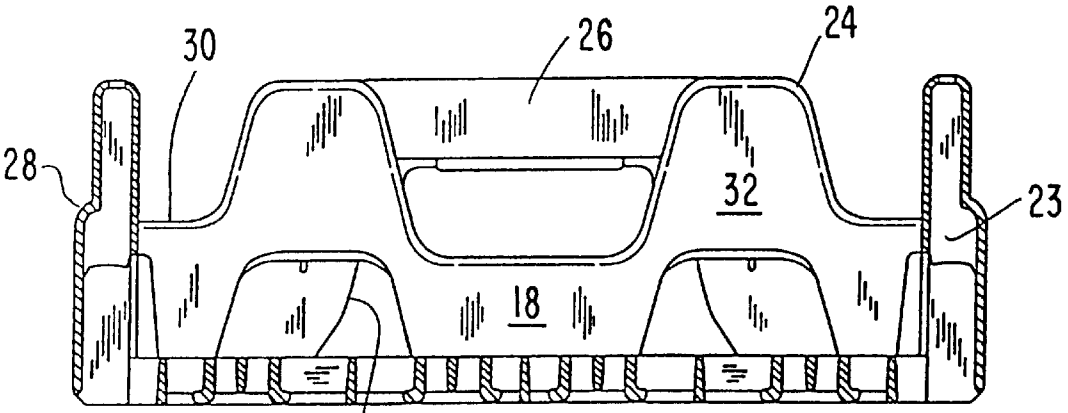
FIG. 9 is a cross-sectional view of the crate taken along line 9—9 of FIG. 5.
Figure 10:
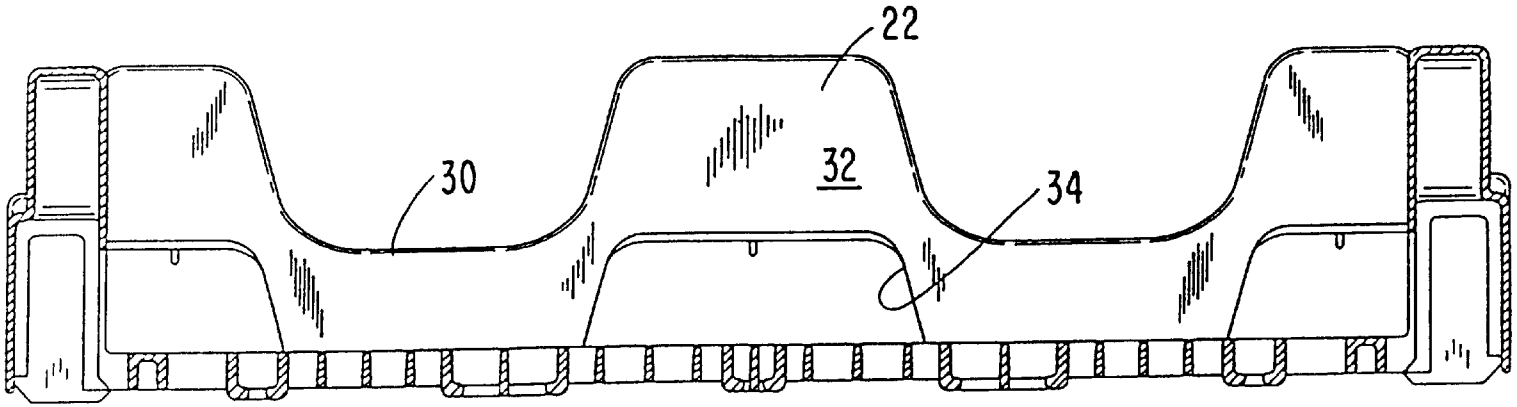
FIG. 10 is a cross-sectional view of the crate taken along line 10—10 of FIG. 5.
Figure 12:
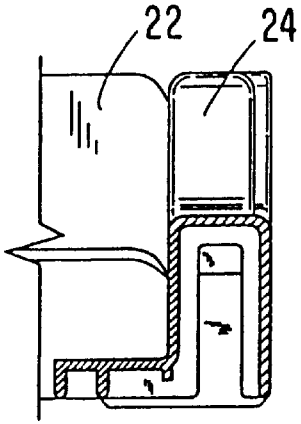
FIG. 12 is a cross-sectional view of the crate taken along line 12—12 of FIG. 5.
Figure 11:
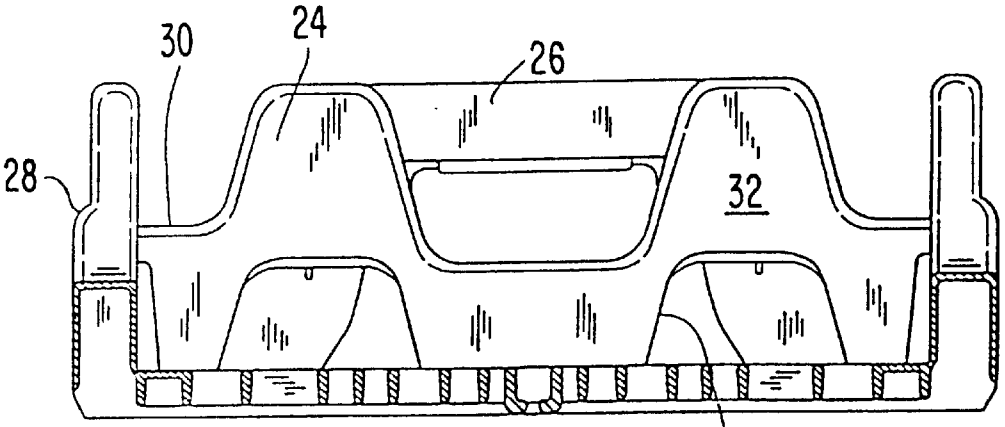
FIG. 11 is a cross-sectional view of the crate taken along line 11—11 of FIG. 5.

In the preferred embodiment of crate 10, teeth 22 along the sidewalls are specifically configured to provide openings that make the labels of cardboard bottle carrier visible. This is best seen in FIG. 7 which illustrates cardboard carriers C loaded with bottles B with the having a label L on their long sides. Labels L are visible through the openings defined between teeth 22 due to the configuration of teeth 22. This visibility is important in a retail setting for identification and aesthetic purposes. For maximum exposure of labels L while providing sufficient support to the carriers, the center tooth is slightly larger to support portions of both carriers.

Handles 26 on the endwalls of crate 10 are integrally molded with the lower wall portion but extend upward so that the tops of the handles are flush with the tops of endwall teeth 24. Relatively large handle cut-outs 38 are provided to the outside so handles 26 are bar-like in construction in that there is complete clearance both above and below the handles for a user's hands to grasp the crate in either the palm-up or palm-down positions. Also, since the handles are spaced slightly outwardly from endwall teeth 24, more space is provided between the bottle carriers loaded in the crate and the handles.

In handling a loaded crate, the palm-up position refers to the position of a user's hands when the fingers are inserted below handle 26 from the outside of the crate such that the palms generally face up and inward. The palm-down position refers to the position of a user's hands when the fingers are inserted below handle 26 from the inside of the crate such that the backs of the hands are facing each other and the palms are generally facing down and/or outward. The height of handles 26 and their length, ensure that a user's hands have sufficient clearance to grasp the handle in either the palm-up or palm-down positions. Providing a user with the option of handling the crate in either hand position helps alleviate fatigue and prevent hand-wrist injuries since a natural grasping motion can be used. The importance of this feature can be appreciated when the crate is loaded with bottles. The handles on prior crates or trays may have been too constricting on some user's hands, and may have required awkward and harmful hand/wrist positions, particularly when lifting and handling heavy loaded crates.

Figure 3:
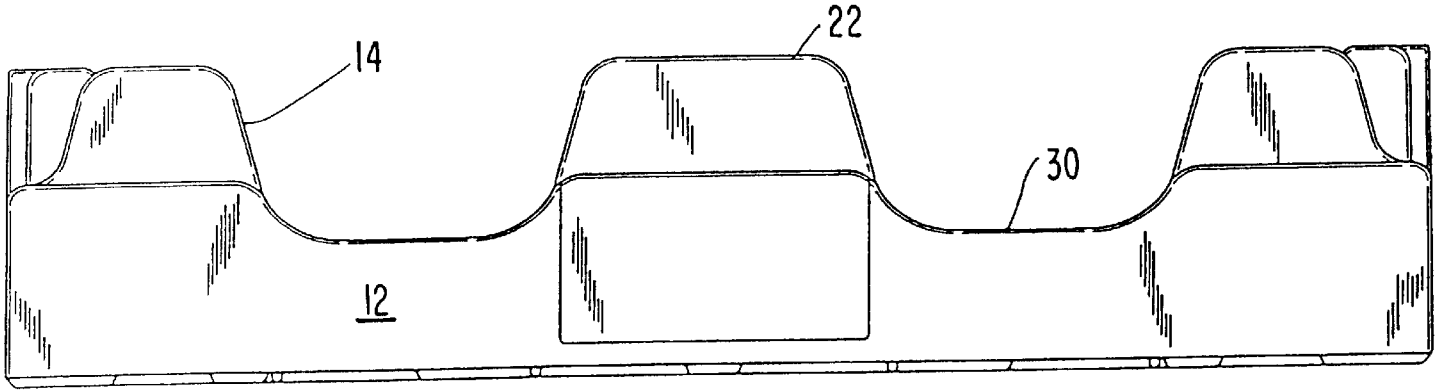
FIG. 3 is an elevational view of a sidewall of the crate of FIG. 1.
Figure 4:
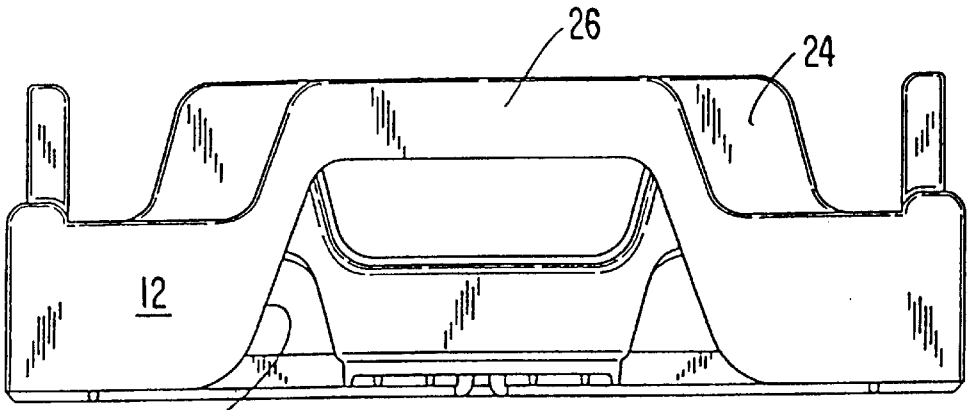
FIG. 4 is an elevational view of an endwall of the crate of FIG. 1.

Crate profile views, FIGS. 3 and 4 show that exterior of lower wall portion 12 is preferably not quite flush with the floor bottom surface so that the floor bottom surface is left exposed somewhat in profile. Leaving lower wall portion 12 slightly higher than the floor bottom surface facilitates handling by allowing hand trucks to slide easily under the crate, and prevents the exterior lower wall portion from fraying and catching on bottle tops in stacked columns of crates.

The crate of the present invention combines the features of nestability, strength and visibility. In constructing the crate, many design parameters must be determined with the goal of enhancing the above mentioned characteristics without unduly sacrificing any of them. Visibility is important both for permitting attractive display of the carriers, and the present invention provides maximum visibility for its size without sacrificing strength and nestability.

Figure 5:
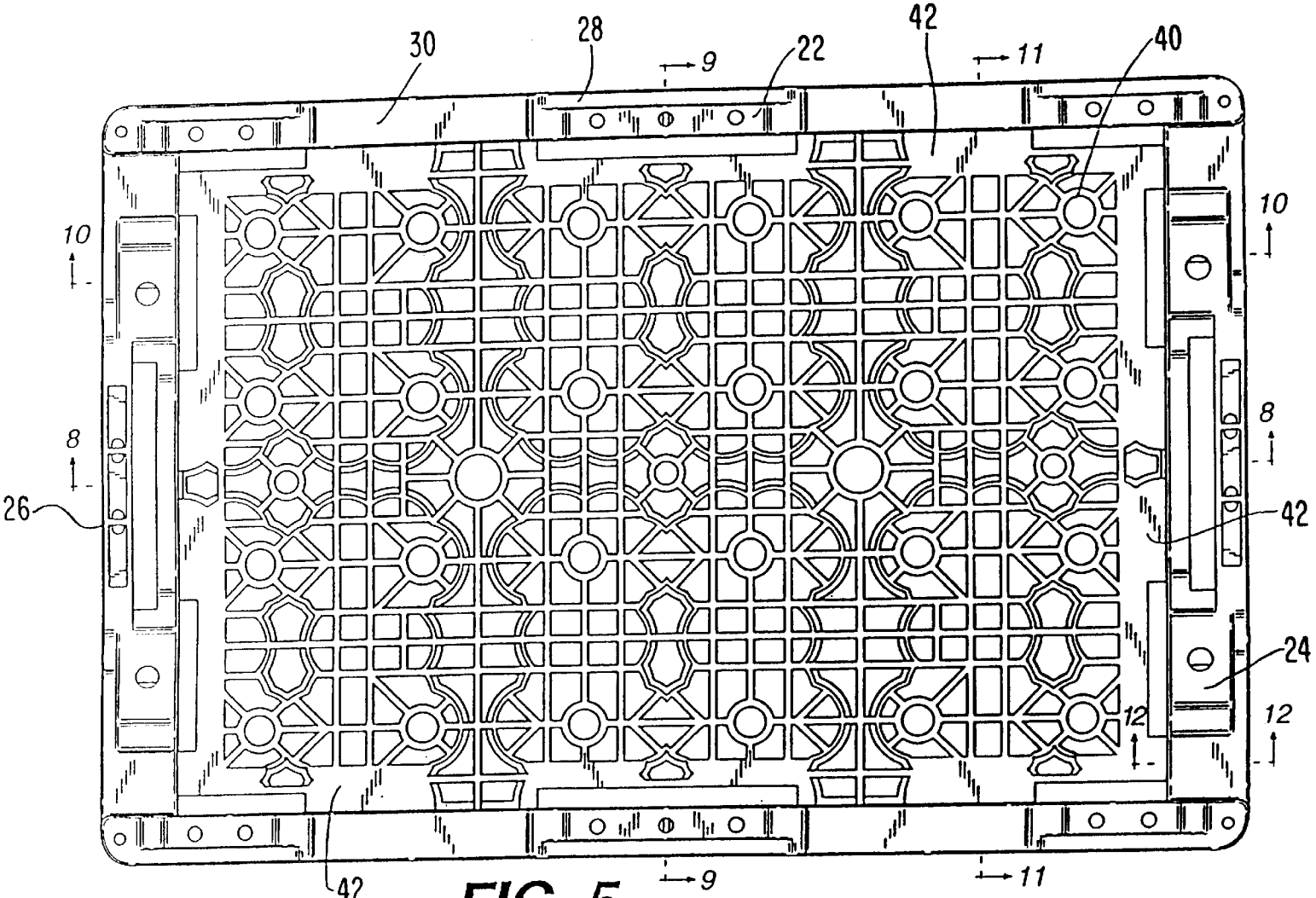
FIG. 5 is a top plan view of the crate of FIG. 1.

Floor 16 preferably has a lattice-like configuration having a pattern of open spaces as best seen in FIGS. 3, 5 and 6. The floor comprises a system of grid-like longitudinal and lateral struts traversing the floor in perpendicular relation to one another and connecting circular lattice elements together. A plurality of circular lattice elements define the locations of bottle tops in a loaded crate stacked therebeneath, and curved lattice members generally surround the circular elements to define bottle top location areas. Interstitial circular members are provided between bottle tops areas as well. The open floor design provides a light weight crate, and is practical for allowing any liquids to drain through floor 16. The floor is generally flat and open so as not to interfere with the bottle carriers.

Floor 16 has an upper or top surface 40 which is generally flat and includes a plurality of support areas for supporting bottle carriers thereon. Arranged along the sidewalls and endwalls adjacent interior panels 18, are solid floor surfaces 42 which ensure that a strong connection between the wall structure and floor.

The support areas are arranged in rows and columns to thereby define an array. In the preferred embodiment, crate 10 is designed to hold four six-packs of bottles in cardboard carriers. The support areas are configured so that bottles in an array are retained in relatively close relation so as to prevent jostling of the bottles during handling. Excess movement of the bottles is to be avoided in order to ensure that the bottles remain in a vertically upright position to most advantageously bear the load of bottles stacked or cross-stacked thereabove.

Floor 16 has a bottom surface 44 which has distinctive structural features. Floor bottom surface 44 is configured to allow for stacking and cross-stacking of loaded crates. Cross-stacking is done by rotating a top crate 90 degrees about a vertical axis and lowering onto a bottom crate or crates. During shipping and handling crates may be moved by machines and it is advantageous to use crates which can be stably stacked or cross-stacked. Additionally, when the crates are used to display the containers in a retail setting, the retailer may wish to cross-stack the crates for display or space reasons.

Floor bottom surface 44 has a plurality of bottle top location areas defined by curved lattice elements 46, best seen in FIGS. 2 and 6. The positions of curved lattice elements 46 are determined to provide a range within which the bottle tops in a loaded crate therebeneath may reside and still provide safe stacking and cross-stacking. The bottoms of curved lattice elements 46 extend downward slightly from the bottom of the rest of the floor bottom surface. The receiving areas help retain bottles in vertically upright positions to bear the load of bottles stacked or cross-stacked thereabove.

From the foregoing detailed description, it will be evident that there are a number of changes, adaptations, and modifications of the present invention which come within the province of those skilled in the art. However, it is intended that all such variations not departing from the spirit of the invention be considered as within the scope thereof as limited solely only by the claims appended hereto.

What is claimed is:

1. A low depth nestable display crate for six-pack bottle carriers comprising:

a floor for supporting the bottle carriers; and a doubled thickness wall structure having endwalls and sidewalls extending around the periphery of said floor and comprising a lower wall portion including a solid exterior surface along said sidewalls and interior bottle carrier support surfaces connected to said floor, an upper wall portion comprising spaced tooth members extending upward from said lower wall portion and defining display openings between said tooth members along said sidewalls, wherein said display openings are sized to reveal labels on the bottle carriers for displaying the bottle carriers in a loaded crate, and a handle bar integrally molded with said tooth members along said endwalls and said lower wall portion defining a cut-out, said cut-out providing said handle bar complete clearance below said handle bar, and complete clearance above said handle bar from a stacked crate thereabove, and provide sufficient clearance between said handle bar and the bottle carriers loaded in said crate to enable a user's hand to completely encircle said handle bar.

2. The crate of claim 1, comprising interior teeth panels provided on the interior side of said tooth members, said teeth panels being flat to provide lateral support to the bottle carriers loaded in said crate.

3. The crate of claim 1, wherein said interior surface of said lower wall portion includes an alternating arrangement of interior panels connected to said floor and cut-outs.

4. The crate of claim 1, wherein said tooth members extend above and inwardly from said lower wall portion to form a shoulder therebetween.

5. The crate of claim 1, further comprising nesting ribs provided within at least one of said tooth members to bear against a top surface of a corresponding tooth member in a crate nested therebelow.

* * * * *